United States Patent [19]

Honma

[11] Patent Number: 4,615,609

[45] Date of Patent: Oct. 7, 1986

[54] IMAGE FORMING APPARATUS INCLUDING TURN-ON AND TURN-OFF SETTING MEANS

[75] Inventor: Toshio Honma, Tokyo, Japan

[73] Assignee: Canon Kabushiki Kaisha, Tokyo, Japan

[21] Appl. No.: 495,680

[22] Filed: May 18, 1983

[30] Foreign Application Priority Data

| | | | |
|---|---|---|---|
| May 24, 1982 | [JP] | Japan | 57-87528 |
| May 24, 1982 | [JP] | Japan | 57-87529 |
| May 24, 1982 | [JP] | Japan | 57-87530 |
| May 24, 1982 | [JP] | Japan | 57-87531 |
| May 24, 1982 | [JP] | Japan | 57-87532 |

[51] Int. Cl.[4] ..... G03G 21/00

[52] U.S. Cl. ..... 355/14 R; 355/3 R

[58] Field of Search ..... 355/14 R, 14 C, 3 R; 307/139, 140, 141, 141.4

[56] References Cited

U.S. PATENT DOCUMENTS

| | | | |
|---|---|---|---|
| 4,344,000 | 8/1982 | Schornack et al. | 307/141 X |
| 4,412,735 | 11/1983 | Tsukata et al. | 355/14 R |

*Primary Examiner*—R. L. Moses

*Attorney, Agent, or Firm*—Fitzpatrick, Cella, Harper & Scinto

[57] ABSTRACT

An image forming apparatus comprises an image forming unit, a setting key for setting a turn-on or turn-off time of a power supply of the image forming unit and a control unit for controlling turn-on or turn-off of the power supply in accordance with the time preset by the setting key. The control unit inhibits the setting by the setting key if the turn-on or turn-off period of the power supply is shorter than a predetermined time period. The control unit further inhibits the turn-on or turn-off of the power supply during the operation of the image forming apparatus and within a predetermined time period after the completion of the image forming operation.

29 Claims, 14 Drawing Figures

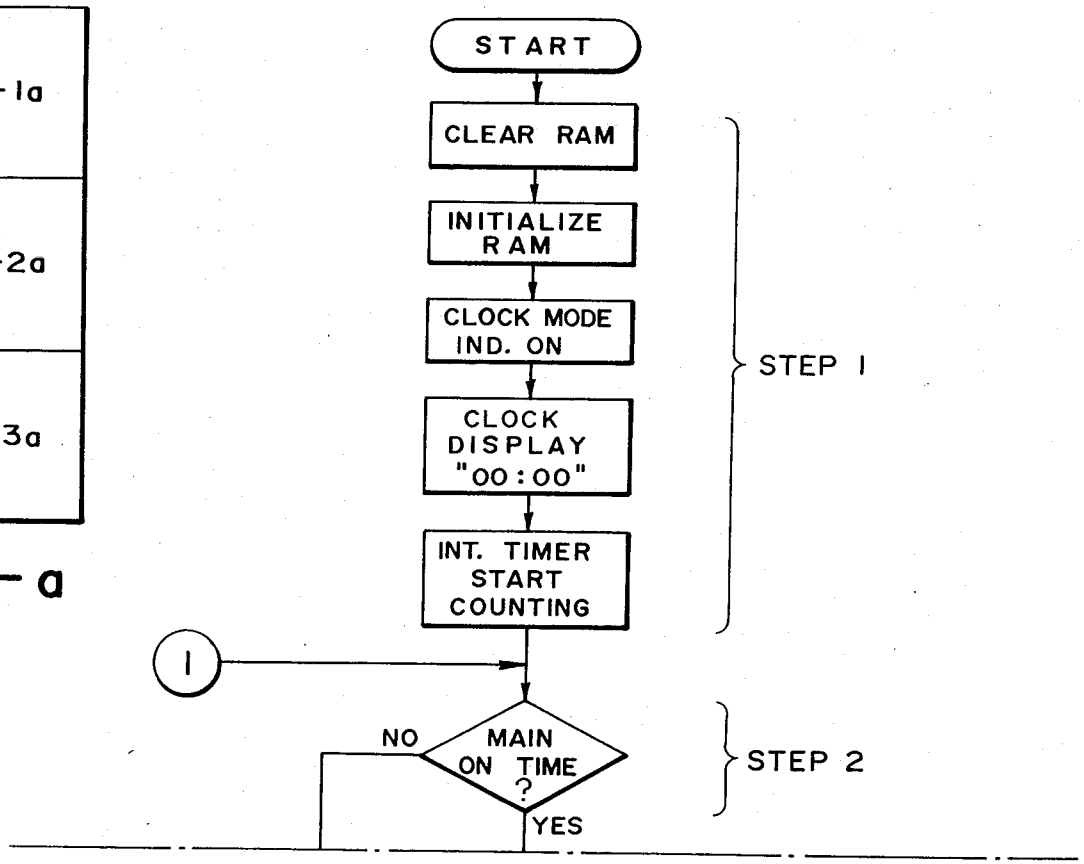
FIG. 4-1a
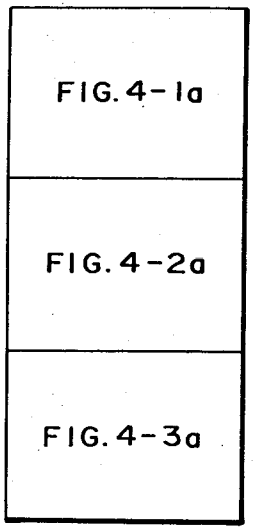
FIG. 4-a

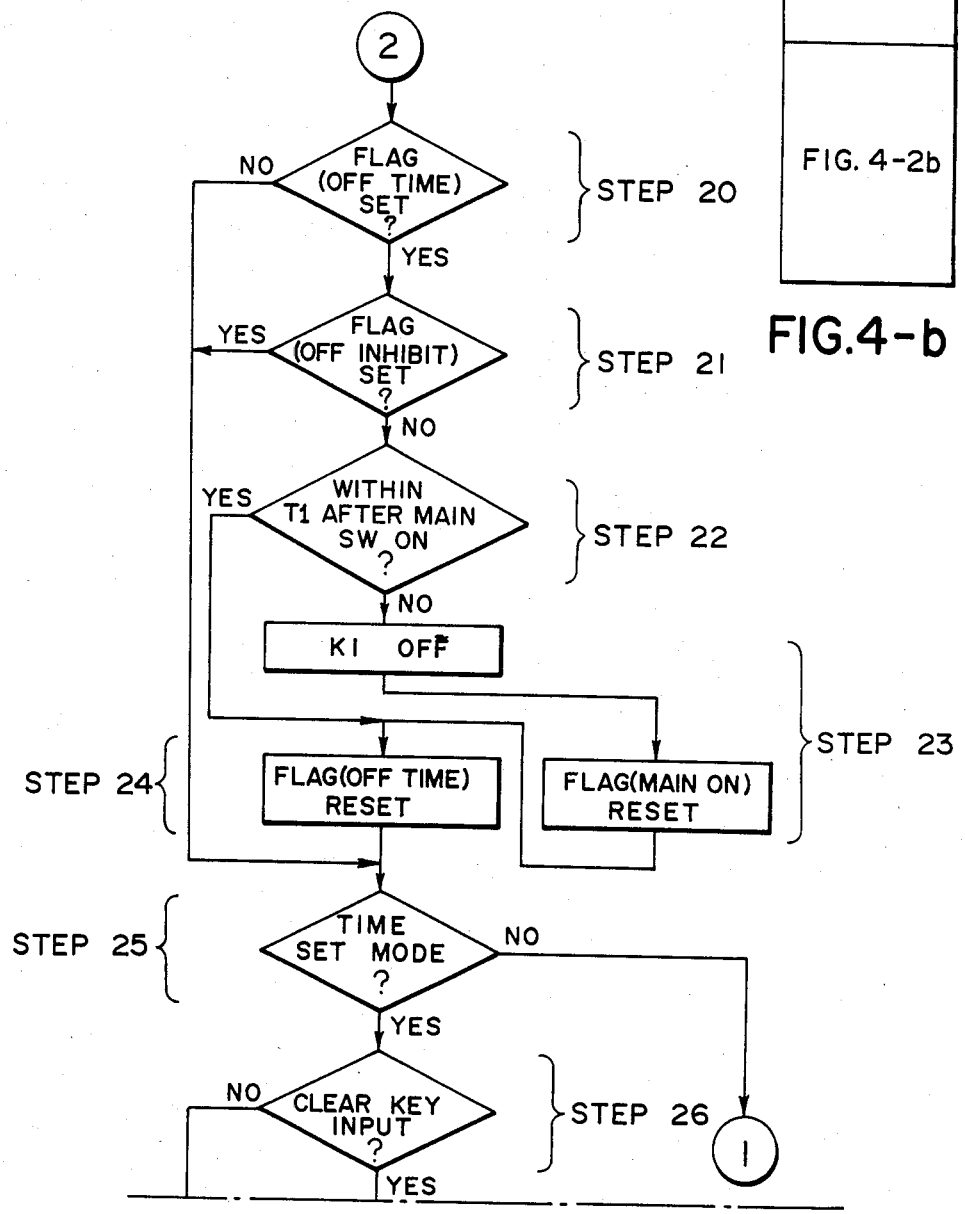
FIG.4-1b
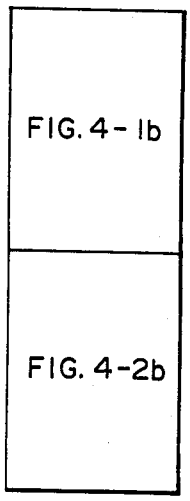
FIG.4-b

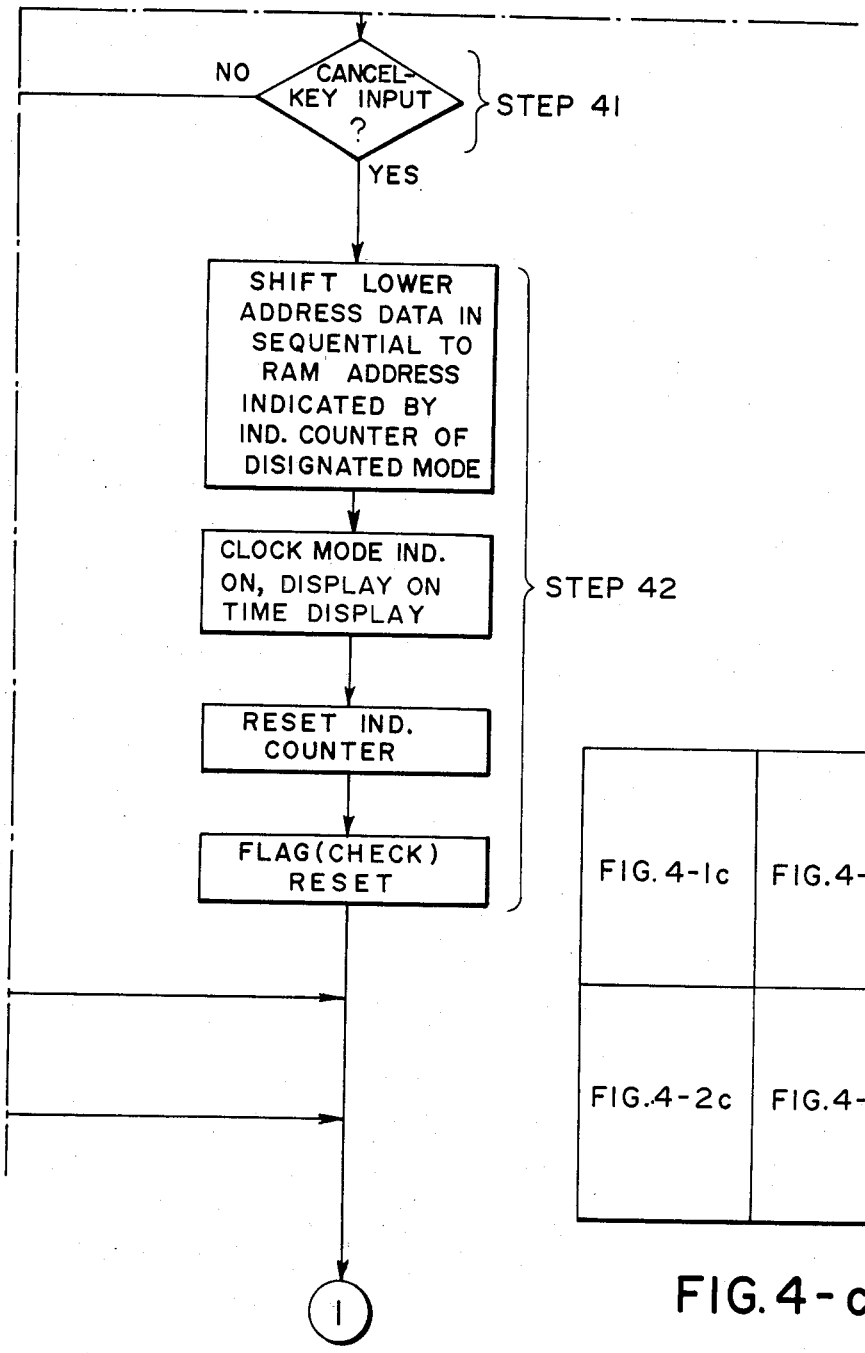
FIG.4-4c
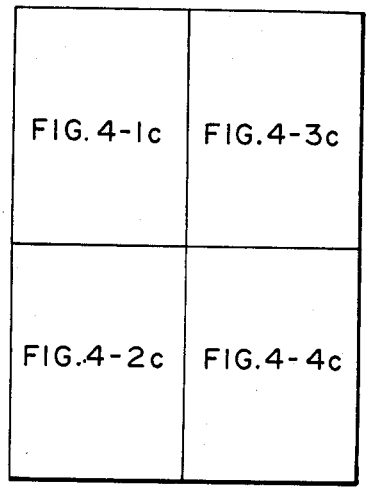
FIG.4-c

| FLAG | SET | RESET |
|---|---|---|
| FLAG(MAIN ON) | SET WHILE POWER RELAY(KI)61 ON | RESET WHILE (KI) 61 OFF |
| FLAG(ON TIME) | SET WHERE THE CURRENT TIME ACCORDS WITH POWER-ON SET TIME | RESET AFTER(KI)61 ON |
| FLAG(OFF TIME) | SET WHERE THE CURRENT TIME ACCORDS WITH POWER-OFF SET TIME | RESET AFTER(KI)61 OFF |
| FLAG(OFF ALARM) | SET WHERE THE CURRENT TIME ACCORDS WITH POWER-OFF ALARM DISPLAY SET TIME | RESET WHERE(KI)61 IS ON AND MAIN SW 127 IS INPUTTED DURING KI ON |
| FLAG(OFF INHIBIT) | SET BY EXCHAGE DATA FROM DEVICE CONTROLLER 65 WHILE COPY OPERATING | RESET WHERE COPY APPARATUS IS NOT COPY OPERATING |
| FLAG(CHECK) | SET WHERE CHECK KEY 136 IS DEPRESSED IN MODE OF ON-TIME OR OFF-TIME | RESET AFTER CANCEL KEY, SET KEY, AND START KEY ARE INPUTTED IN MODE OF ON-TIME OR OFF-TIME |

FIG. 5

IMAGE FORMING APPARATUS INCLUDING TURN-ON AND TURN-OFF SETTING MEANS

BACKGROUND OF THE INVENTION

1. Field of the Invention

The present invention relates to a reservation control of a power supply of an image forming apparatus.

2. Description of the Prior Art

In the prior art, the turn-on and turn-off of the power supply of a copying machine have been made manually by a user. For an office copying machine, a first user turns on a power switch when he or she uses the machine in the morning, and a last user or a responsible manager turns off the power switch at the end of working time. Accordingly, it frequently occurs that they forget to turn on or off the switch, and the power is wasted or a work time is lost because the power is off when the user want to make copies in routine works. In order to resolve the above inconvenience, an auto-shut-off function which automatically turns off the power a predetermined time period after the end of the copying operation or a pressure fixing unit has been used to reduce the waiting time. In the former case, however, since the auto-shut-off time is fixed, it is inconvenient to certain users, and in the latter case, a problem of fixing ability is encountered in a high speed copying machine.

SUMMARY OF THE INVENTION

It is an object of the present invention to provide an apparatus which resolves the disadvantages of the prior art apparatus.

It is another object of the present invention to provide an image forming apparatus which allows a user to set reservation of a power supply by a control panel of the image forming apparatus without using any special means.

It is other object of the present invention to provide an image forming apparatus which resolves a problem encountered when the power supply is turned on or off by a timer, for example, when a turn-off time of the power supply preset by the timer is reached during the formation of an image or during the exchange of an original, or when the turn-off time of the power supply preset by the timer is reached immediately after the manual turn-on of the power supply.

It is other object of the present invention to provide an image forming apparatus which informs to a user that the turn-on or turn-off time of the power supply preset by the timer is approaching, and if the user wants to continue the use of the apparatus, enables the user to cancel the turn-off reservation of the power supply.

It is other object of the present invention to provide an image forming apparatus which allows the user to reserve the turn-on time or turn-off time of the power supply and to confirm or cancel the reserved times by a simple operation.

It is other object of the present invention to provide an image forming apparatus which resolves various troubles caused by the reservation of the turn-on time or turn-off time of the power supply.

BRIEF DESCRIPTION OF THE DRAWINGS

FIG. 5 illustrates flags used in the general flow charts of said FIGS. 4-1*a* et seq.

DETAILED DESCRIPTION OF THE PREFERRED EMBODIMENTS

Figure 1:
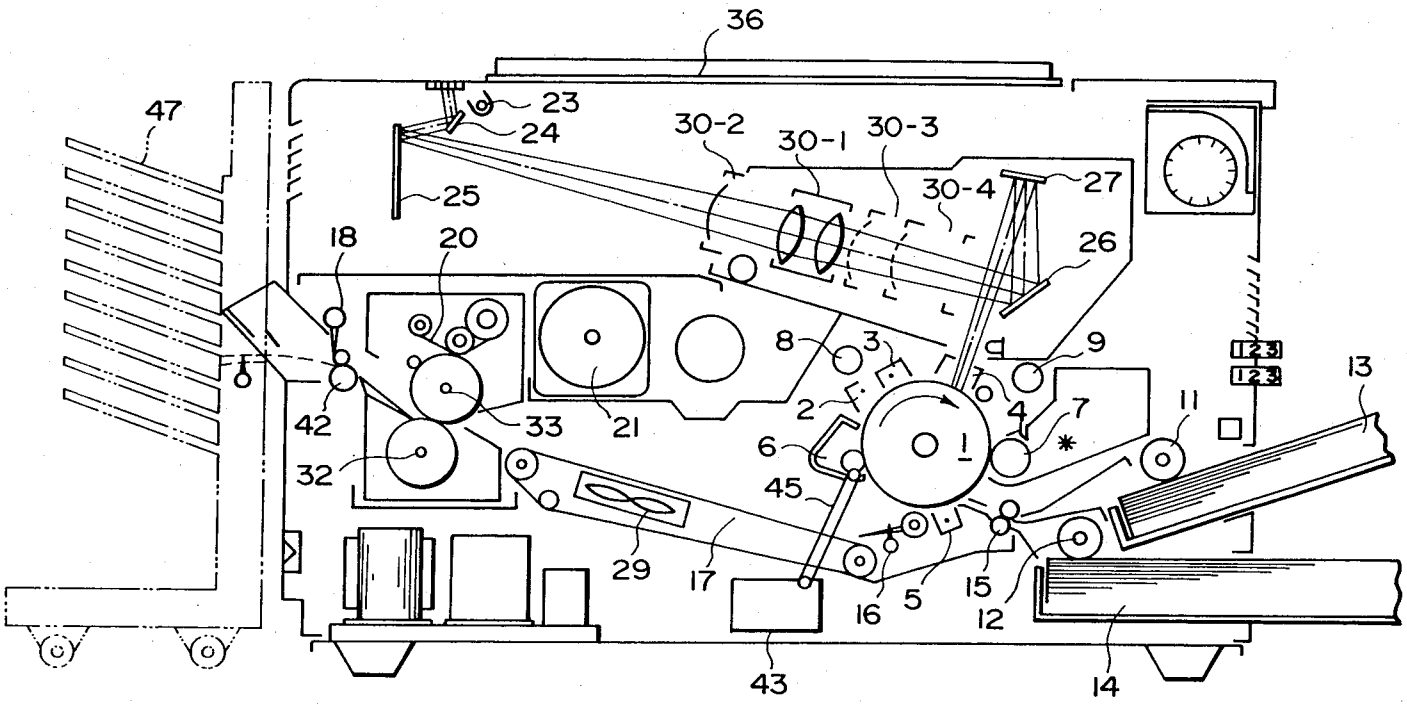
FIG. 1 shows a sectional view of a copying machine to which the present invention is applied.

FIG. 1 shows a sectional view of a copying machine to which the present invention is applied. A construction and an operation thereof are explained below.

A surface of a drum 1 comprises a three-layer seamless photosensitive material including a CdS photosensitive material. It is rotatably supported on a shaft and rotated in a direction of an arrow by a main motor 21 when a copy key is depressed.

After the drum 1 has been rotated by a predetermined rotation angle and a potential control processing (pre-processing) has been completed, a text mounted on a text mount glass 36 is illuminated by an illumination lamp 23 which is in union with a first scanning mirror 24, and a reflected light from the original is directed to a lens 30 through the first scanning mirror 24 and a second scanning mirror 25. The first scanning mirror 24 and the second scanning mirror 25 move at a velocity ratio of 1 to $\frac{1}{2}$ so that the original is scanned with optical path length in front of the lens 30 being always kept constant.

The reflected light image passes through the lens 30, a third mirror 26 and a fourth mirror 27 and is focused on the drum 1 at an exposing area.

The drum 1 is discharged by a pre-exposure lamp 8 and a pre-discharger 2 and then corona-charged (for example, positively) by a primary charger 3. Then, the image illuminated by the illumination lamp 23 is slit-exposed onto the drum 1.

Then, the drum 1 is AC-discharged or corona discharged by a secondary charger 4 with the opposite polarity (for example, negative) to that of the primary discharger, and then the surface of the drum 1 is uniformly exposed by a blank exposure lamp 9 so that a high contrast electrostatic latent image is formed on the drum 1. The electrostatic latent image on the photosensitive drum 1 is then developed by a developing roller of a developer 7 as a developed toner image, which is then transferred by a transfer charger 5.

Record papers in an upper cassette 13 or a lower cassette 14 are fed by a paper feed roller 11 or 12 and exactly timed by a registration roller 15 and fed to the photosensitive drum 1 so that a leading edge of the latent image and a leading edge of the record paper are aligned at the transfer area.

Then, the toner image on the drum 1 is transferred to the record paper while the record paper passes through a space between the transfer charger 5 and the drum 1.

After the transfer, the record paper is separated from the drum 1 by a separation belt and it is guided to fixing rollers 32 and 33 by a conveyer belt 17 through a paper sensor 16, and the toner image is fixed by heat. The paper is then ejected to a tray 47 by an ejection roller 42 through a paper sensor 18.

Numeral 29 denotes a conveying fan to assure the convey of the record paper. After the fixing, the fixing roller is cleaned by a web 20.

After the transfer, the drum 1 continues to rotate and the surface thereof is cleaned by a cleaning device 6 comprising a cleaning roller and an elastic blade, and the recovered toners are collected into an ejection toner container 43 by a pipe 45. Then, the next cycle is started.

Figure 2B:
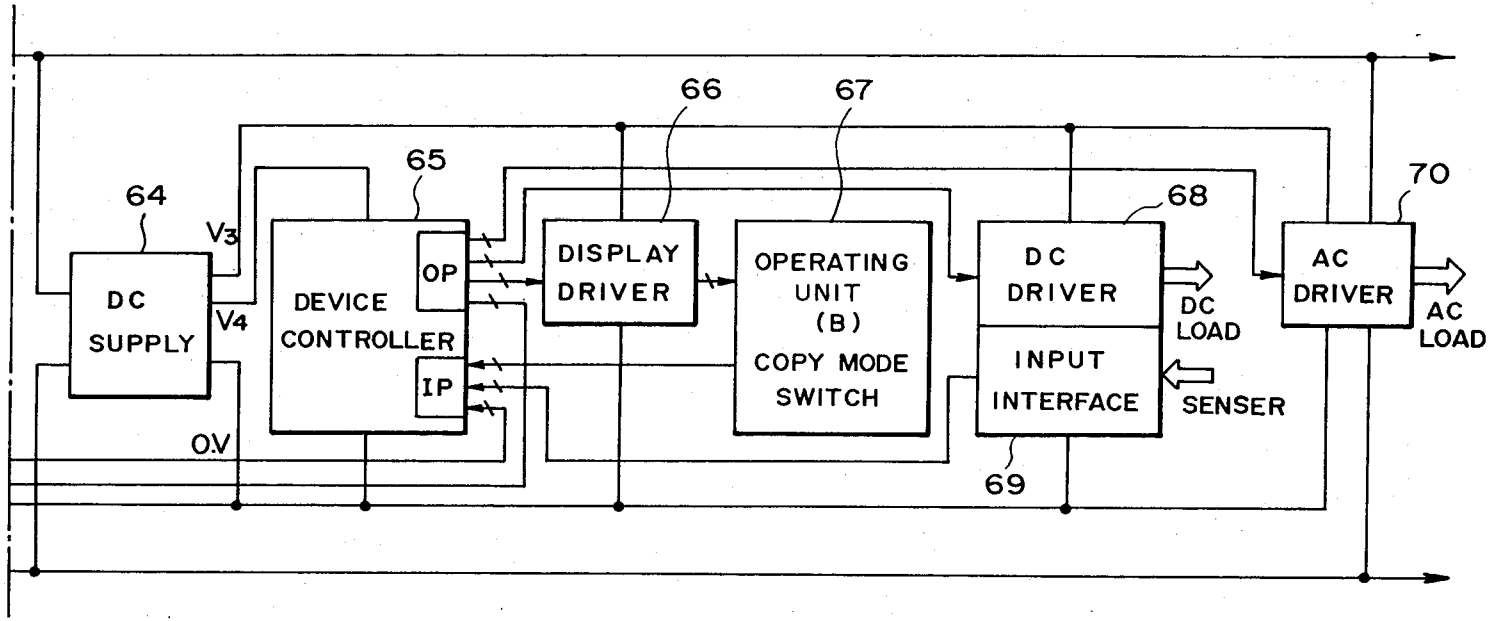
FIGS. 2A and 2B show a block diagram of a control unit in one embodiment of the copying machine of the present invention.
Figure 2:
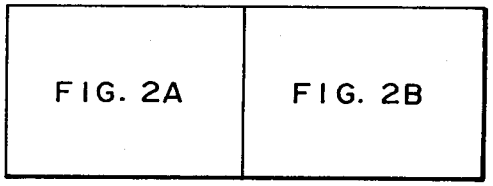
Figure 2A:
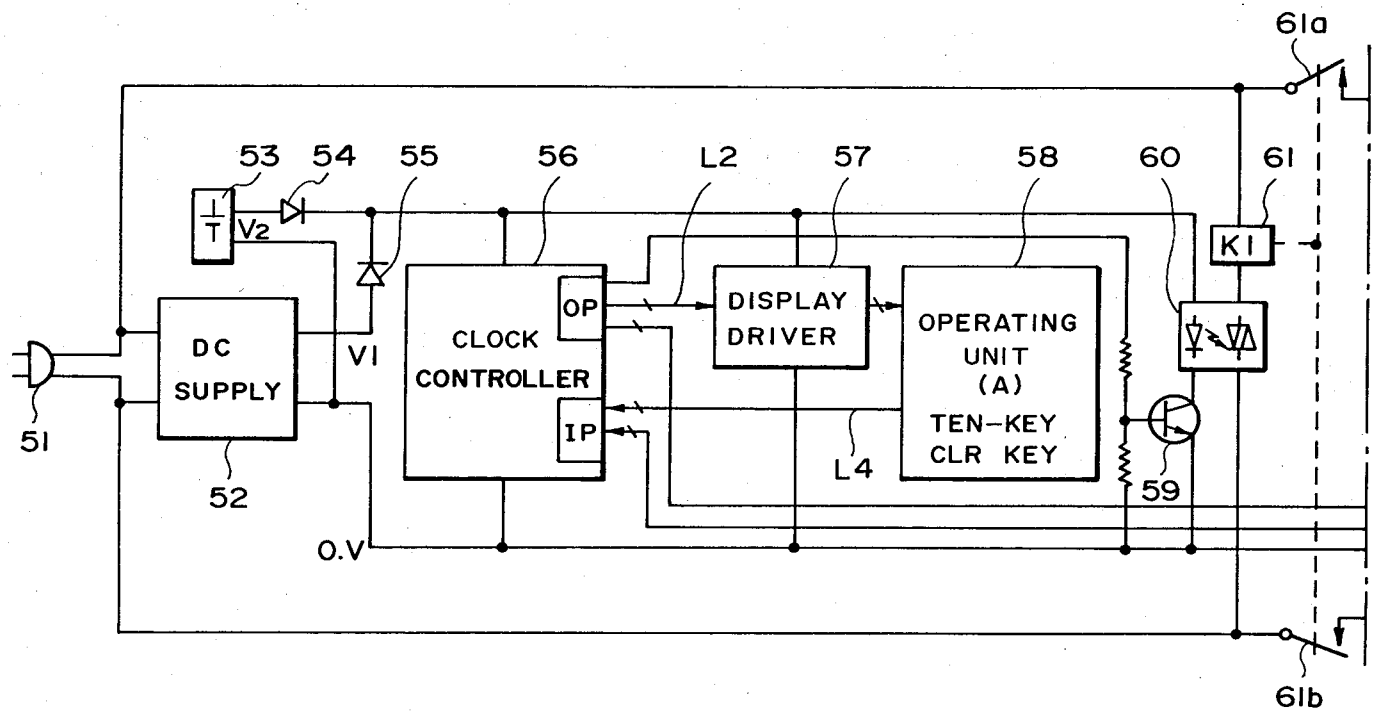

FIG. 2 shows a block diagram of a control unit of the copying machine of the present embodiment. Numeral 51 denotes a plug of the copying machine, numeral 52 denotes a D.C. stabilized power supply for a clock controller 56 and a operating unit (A) 58, which is connected to an A.C. power source through the plug 51 to produce a D.C. voltage continuously, numeral 53 denotes a backup power supply for the clock controller 56 and the operating unit (A) 58, which supplies a D.C. voltage in place of the D.C. power supply 52 when the plug 51 is taken off the A.C. power source, and numerals 54 and 55 denote backcircuit preventing diodes for the backup power supply 53 and the D.C. power supply 52, respectively.

The clock controller 56 clocks time and carries out various power supply controls to the copying machine as described later by a command from the operating unit (A) 58. IP and OP denote input and output ports for the external circuit. Numeral 57 denotes a display driver for the control unit (A) 58.

The operating unit (A) issues commands to the clock controller 56 and displays clock. A detail thereof is explained with reference to FIG. 3. Numeral 59 denotes a transistor for controlling a photo-coupler type semiconductor A.C. switch 60 which controls a power supply relay (K1) 61 of the copying machine.

The power supply relay (K1) 61 controls the power supply of the copying machine by normally open contacts 61*a* and 61*b*. Numeral 64 denotes a D.C. power supply for a sequence controller of the copying machine and it supplies D.C. voltages to a device controller 65, a D.C. driver 68, an input interface 69, an A.C. driver 70 and a operating unit (B) 67. The device controller 65 carries out a well-known copying machine operation control. IP and OP of the device controller 65 denote input and output ports for the external circuit. Numeral 66 denotes a display driver for the operating unit (B) 67.

The operating unit (B) 67 issues copying condition commands to the device controller 65 and displays various status of the copying machine. A detail thereof is explained with reference to FIG. 3. The D.C. driver 68 controls various D.C. loads (solenoid, relay, lamp, etc.) of the copying machine by the commands from the device controller 65. The input interface 69 receives signals from various sensors (position sensors for the optical system, temperature sensor, jam reset switch, etc.) of the copying machine and supplies reshaped signals to the device controller 65.

The A.C. driver 70 controls the various A.C. loads (motor, lamp, heater, etc.) of the copying machine by the commands from the device controller 65.

Figure 3:
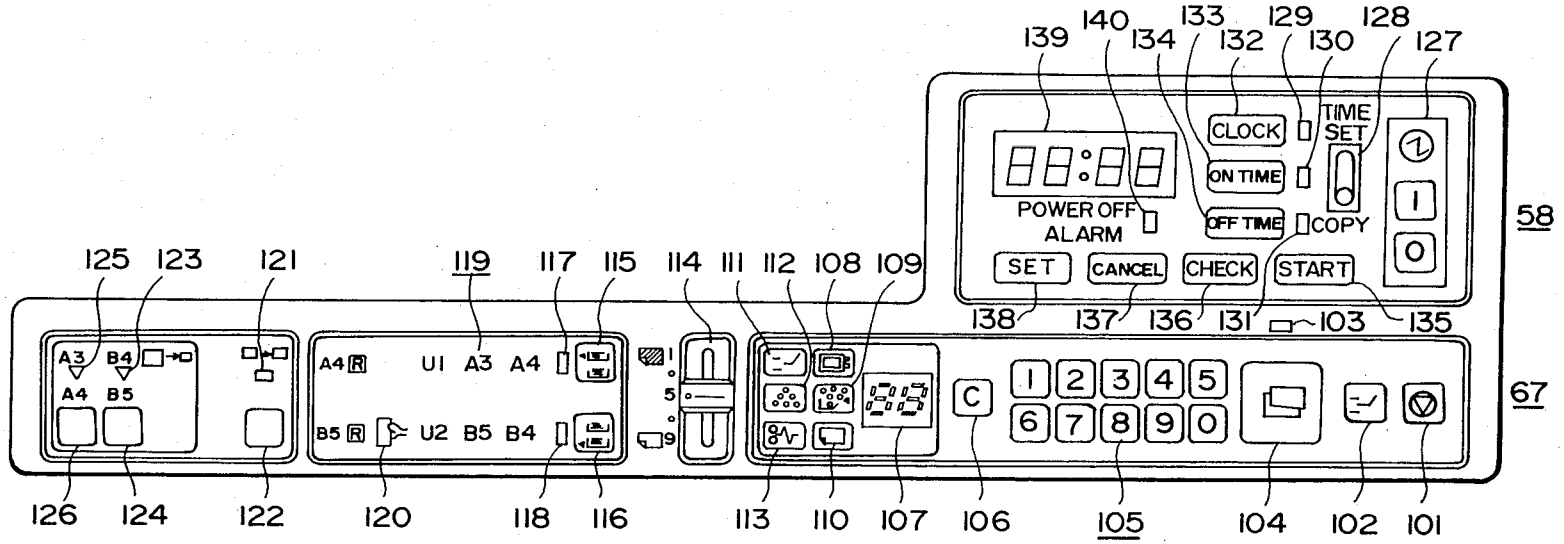
FIG. 3 shows a control panel of the copying machine in accordance with the embodiment of the present invention, FIGS. 4-1*a*, 4-2*a*, 4-3*a*; 4-1*b*, 4-2*b*; and 4-1*c*, 4-2*c*, 4-3*c*, 4-4*c* show general flow charts of a program of a microcomputer in a clock controller.

FIG. 3 shows the operating unit of the copying machine of the present embodiment. It comprises the operating unit (A) 58 and the operating unit (B) 67, and the operating unit (A) includes input switches for setting various conditions of the clock function of the present invention and a clock display. Numeral 127 denotes a main switch which is used to manually turn on and off of the power supply of the copying machine. Numeral 128 denotes a switch which selectively permits the actuation of the various switches on the operating unit (A) 58 excluding the main switch 127, and selects the "0" to "9" ten-key 105 on the operating unit (B) 67 as a time setting key or a copy count input key. In a time set mode of the switch 128, the time setting is permitted, and in a copy mode, the copy count setting is permitted. Numerals 129, 130 and 131 denote mode displays for clock mode, on-time mode and off-time mode, respectively, which display the modes of numerals displayed on a clock display 139.

Numeral 132 denotes a clock mode key which is used to display the clock and adjust time. Numeral 133 denotes an on-time mode key which is used to set a power-on time by the timer control of the copying machine. Numeral 134 denotes an off-time mode key which is used to set a power-off time by the timer control of the copying machine. Numeral 135 denotes a start key which is used to restart the clock in the time adjustment in the clock mode.

Numeral 136 denotes a check key which is used to display the power-on time and the power-off time set in the on-time mode or the off-time mode by the display 139 for checking. Numeral 137 denotes a cancel key which is used to cancel the on-time or off-time displayed on the display 139 by the input from the check key 136. Numeral 138 denotes a set key which is used to set the time displayed on the display 139 as the power-on time or the power-off time. The display 139 displays the time in the respective modes and displays a present time during the copy mode. Numeral 140 denotes a power-off alarm display which alarms when the power-off time by the timer control is approaching.

The operating unit (B) is next explained. Numerals 115 and 116 denote keys for selecting the upper cassette and the lower cassette, respectively, and numeral 114 denotes a slide lever for setting a copy density. A position of 5 corresponds to a standard density.

Numeral 105 denotes the ten-key for setting the copy count and the time in each of the modes, numeral 106 denotes a clean key for cancelling the number, numeral 102 denotes an interruption key for making a different number of copies before the completion of the preset number of copies by the ten-key 105, numeral 104 denotes a copy key for commanding the start of the copying, and numeral 101 denotes a stop key for stopping the copying during the continuous copying of the preset number of copies. The stop key 101 also serves as a command key to release the mode when the interruption is selected by the interruption key 102. Numeral 122 denotes an equi-scale copy mode selection key and numeral 121 denotes a display therefor, which is lit during the equi-scale copy mode. Numerals 124 and 126 denote reduction scale copy mode selection keys from size B4 to size B5 and from size A3 to size A4, respectively. A reduction scale factor is 0–67 for both cases. Numerals 123 and 125 denote displays corresponding to the keys 124 and 126, respectively, which are lit during the mode selection. Numerals 117 and 118 denote displays for display the cassette selected by the upper and lower cassette selection keys 115 and 116, respectively, and numeral 119 denotes a display for displaying a type of cassette loaded in the selected stage. When the reduction scale copy mode key 124 or 126 is selected, and if the size of the cassette selected by the cassette selection key 115 or 116 does not fit to the reduction size, the display 119 flashes a fitting cassette to inform it to an operator. During the flashing display, the paper size of the selected cassette is continuously displayed.

Numeral 111 denotes a display for displaying the interruption mode. It is lit when the interruption key 102 is selected, and extinguished when the interrupted copying is completed or when the interruption mode is released by the stop key 101. Numeral 108 denotes a key counter confirmation display which is lit when a key counter is not inserted into a socket of the machine.

Numeral 109 denotes an ejected toner display which is lit when an ejected toner container (not shown) is filled with the toner and extinguished when the ejected toner is removed from the container. Numeral 110 denotes a paper/cassette supply display which is lit when the cassette is not loaded in a selected cassette container or when the papers in the cassette set in the cassette container have been exhausted. Numeral 112 denotes a toner supply display which is lit when the developer in the developing unit is less than a predetermined amount.

Numeral 113 denotes a paper feed check display which is lit when the copy paper is jammed in the machine or when the paper is jammed in an associated sorter.

Numeral 103 denotes a wait display which is flashed if a temperature of a fixing heater is lower than a predetermined temperature when the power supply of the copying machine is manually turned on by the main switch 127 or when it is turned on by the timer control of the present invention, and extinguished when the temperature is higher than the predetermined temperature and the wait-up processing is completed.

Numeral 107 denotes a copy count display. When a desired copy count is set by the ten-key 105, the count is displayed in two seven-segment digits so that the count of 1–99 can be set at a time. The copy count display automatically displays "1" after the power-on of the copying machine or a predetermined time after the end of the copying operation or the selection of the last key. (This is called an auto-clear). It also displays "1" when the clear key is depressed. When the interruption key is depressed, the copy count display displays "1" instead of the copy count which it has been displaying, and displays the copy count set by the keying during the interruption mode.

FIGS. 4-1*a*, 4-2*a*, 4-3*a*; 4-1*b*, 4-2*b*; and 4-1*c*, 4-2*c*, 4-3*c*, 4-4*c* show general flow charts of a program of a microcomputer in the clock controller 56.

FIG. 5 shows a list of set and reset conditions of flags used in the general flow charts of FIGS. 4-1*a*, 4-2*a*, 4-3*a*; 4-1*b*, 4-2*b*; and 4-1*c*, 4-2*c*, 4-3*c*, 4-4*c*.

Figures 1C, 4:
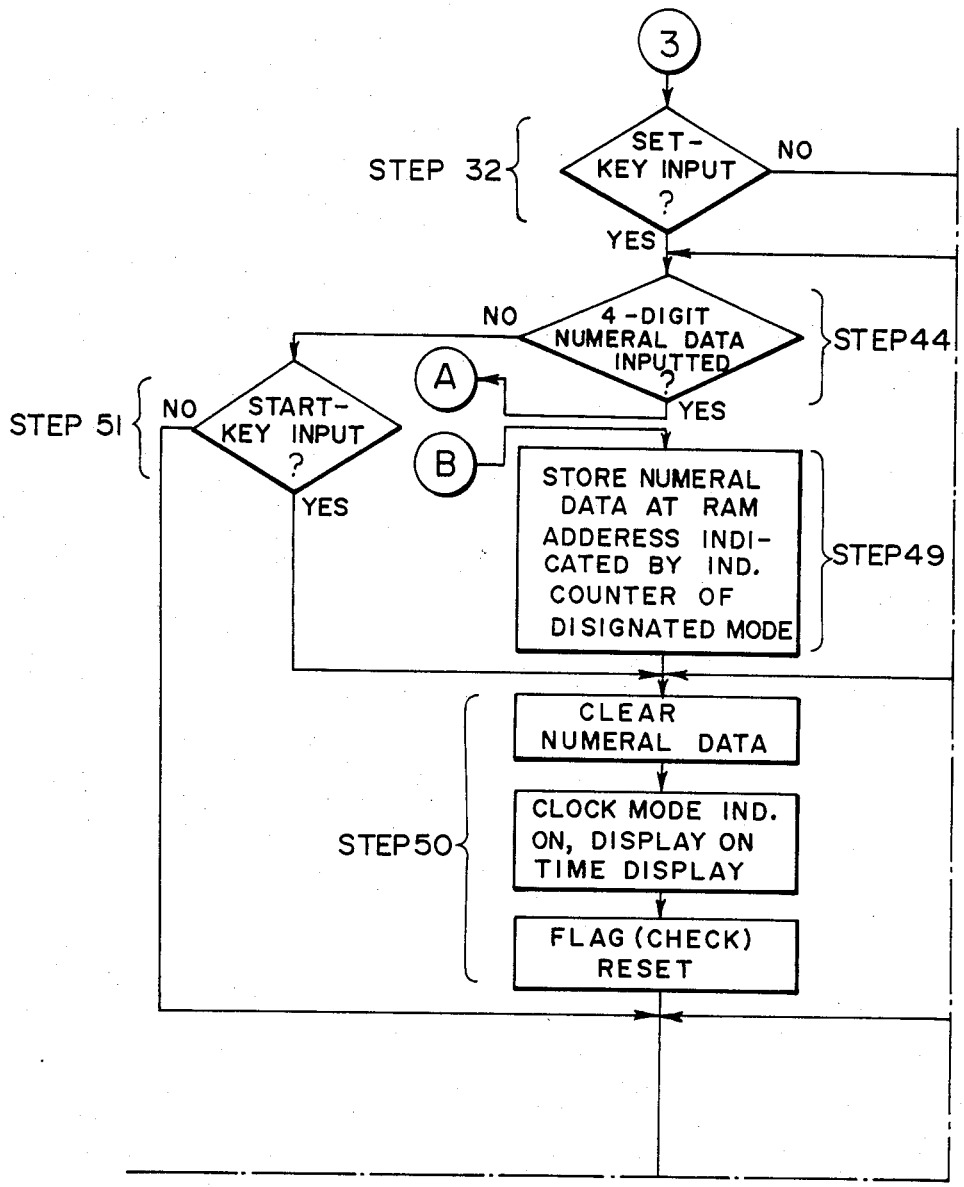
Figures 2A, 4:
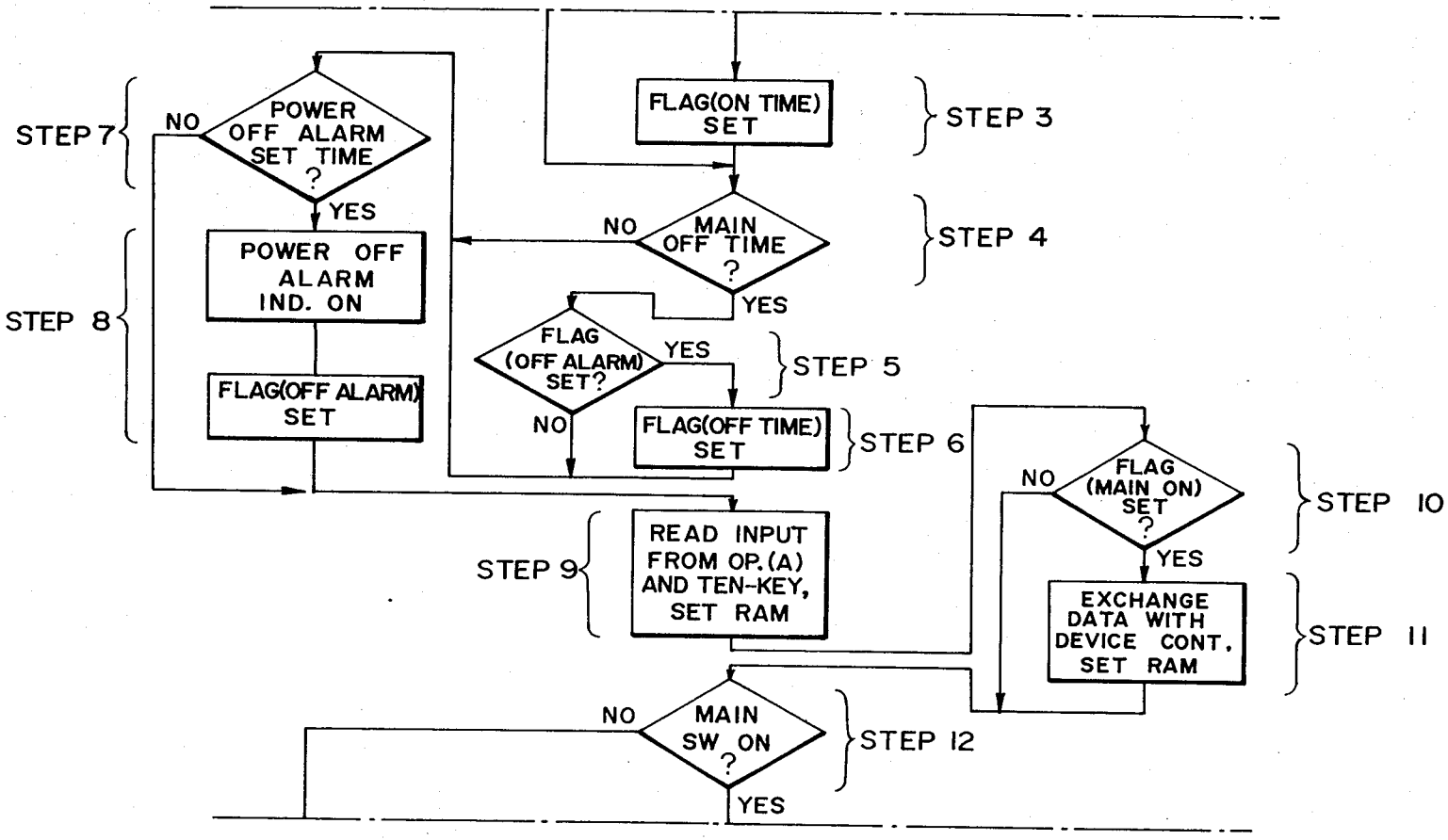
Figures 2B, 4:
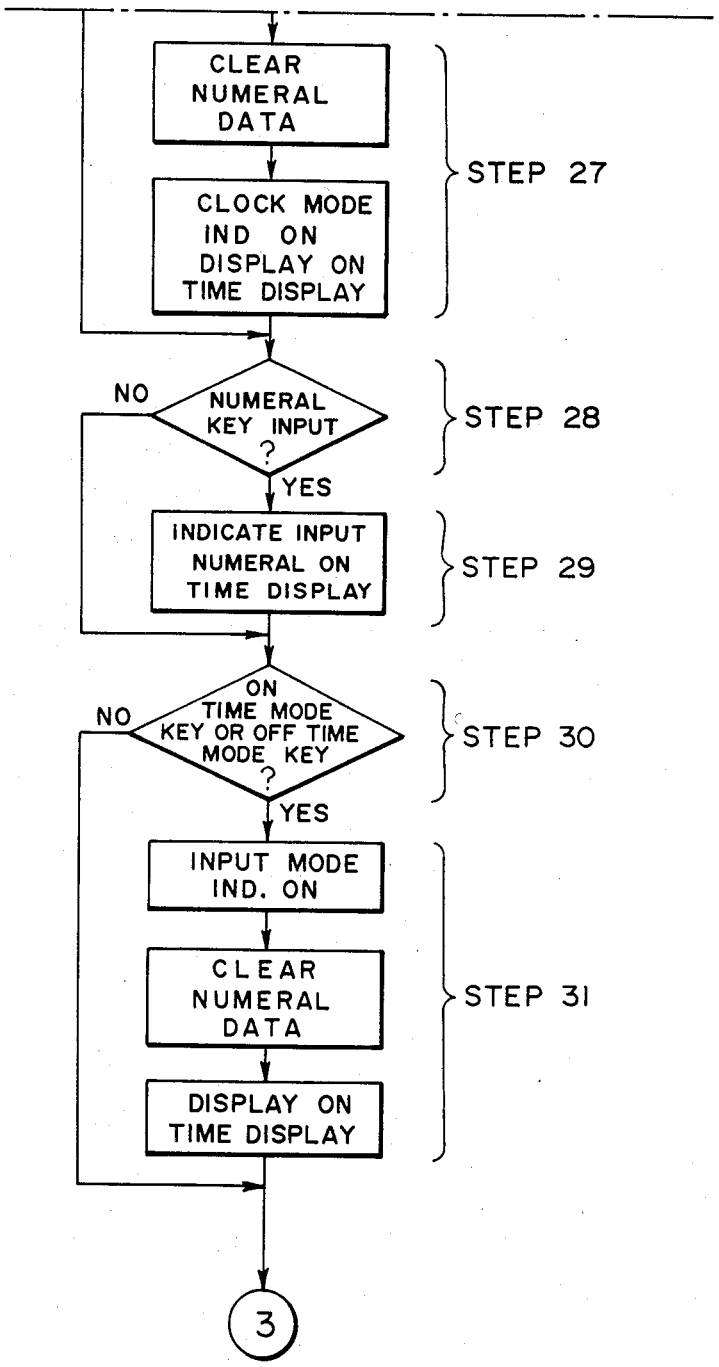
Figures 2C, 4:
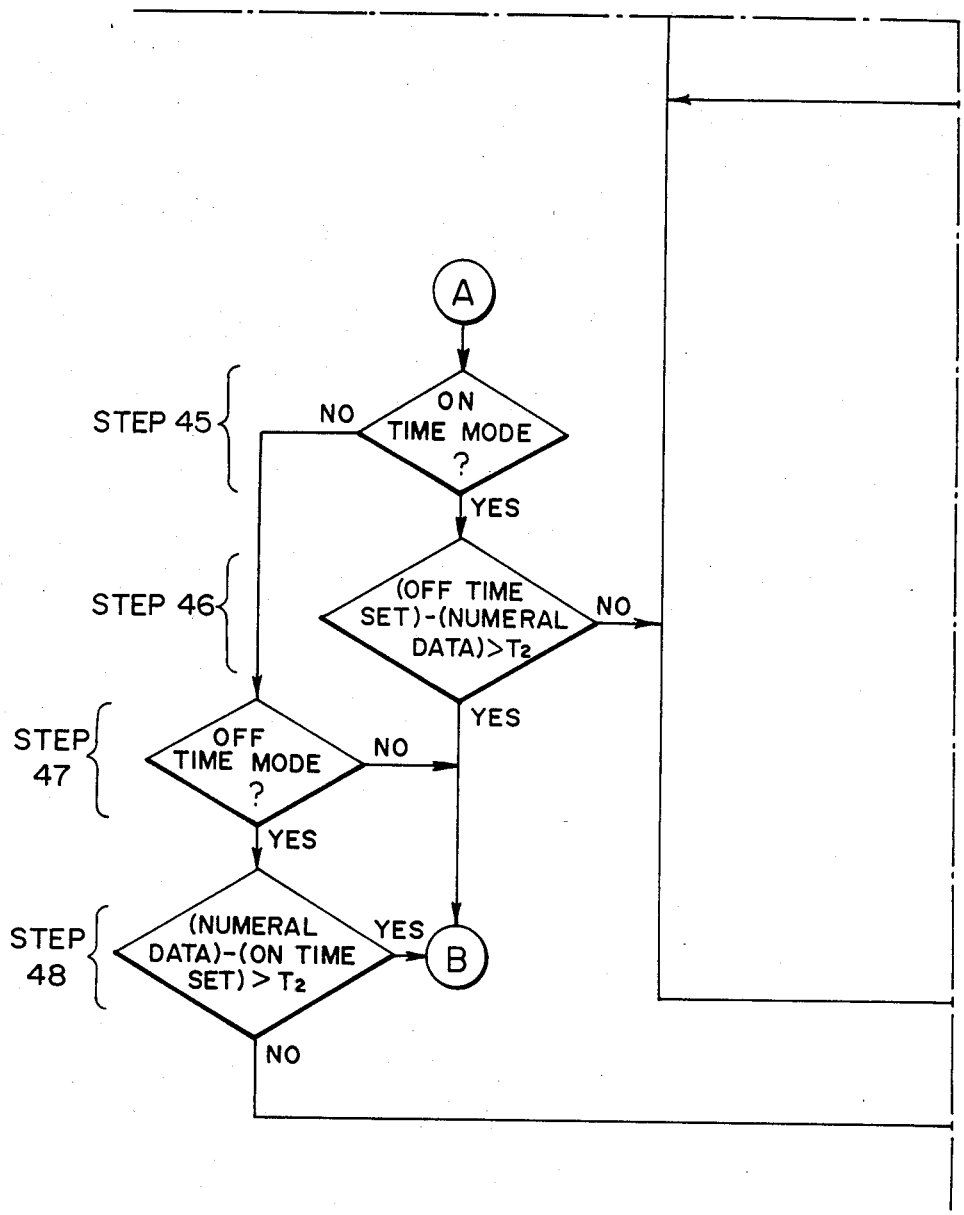
Figures 3A, 4:
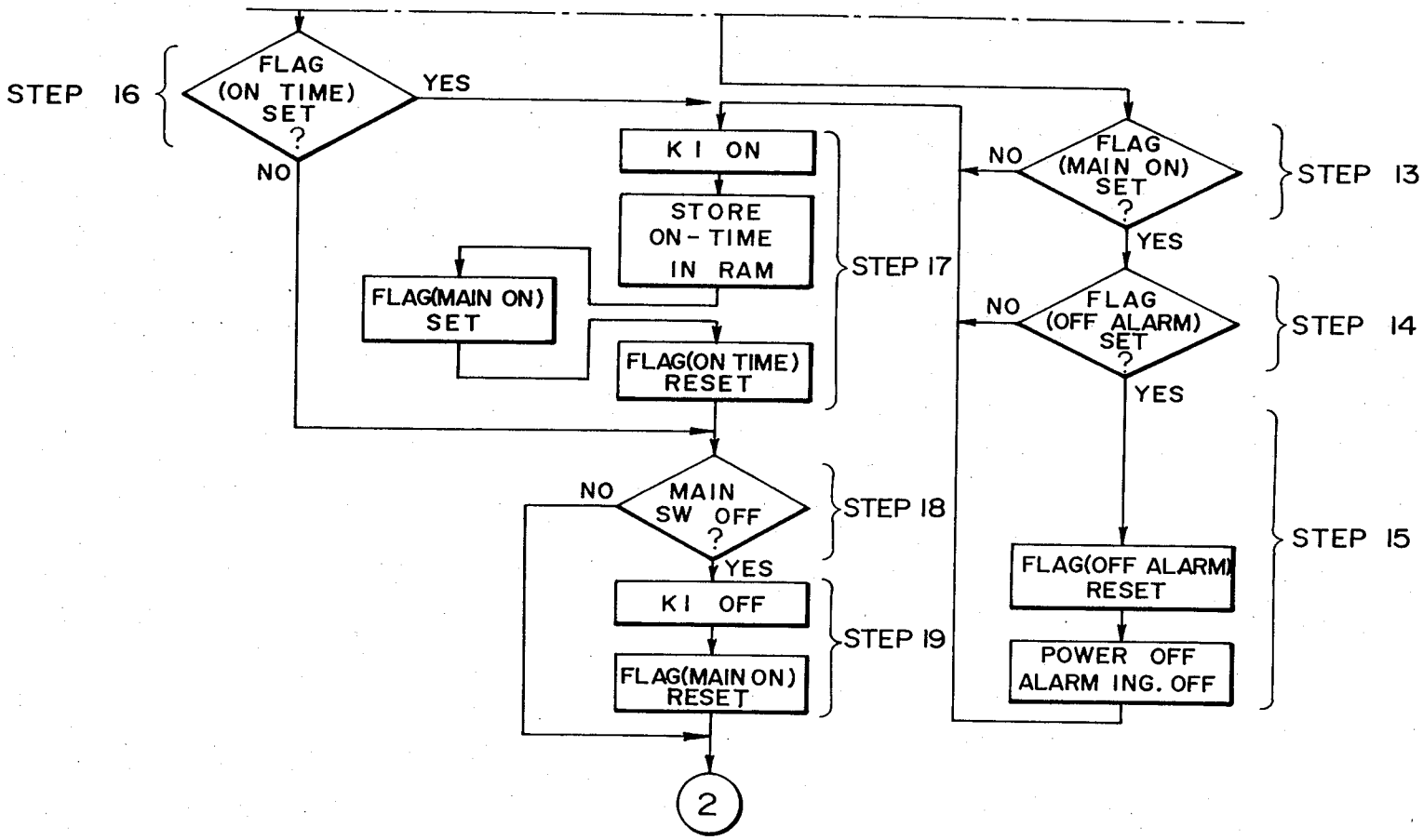
Figures 3C, 4:
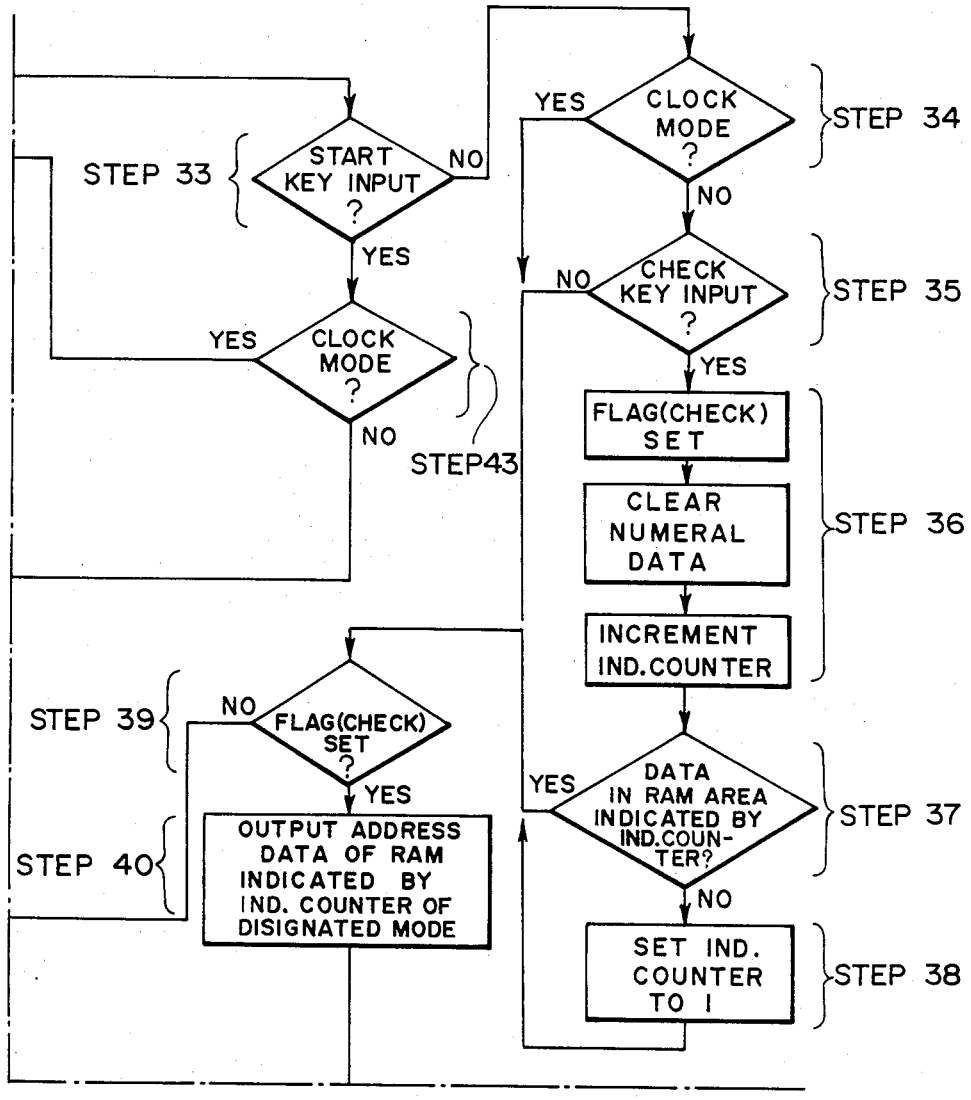

Referring to FIGS. 2, 3 and 5, the general flow charts of FIGS. 4-1*a* to 4-4*c* are now explained. When the plug 51 is inserted in the power supply consent or when the backup power supply 53 is connected to the clock controller 56, the microcomputer in the clock controller 56 starts the operation and executes the program as shown in the flow charts of FIGS. 4-1*a* to 4-4*c* at a step 1 in FIG. 4-1*a*, a RAM in the clock controller 56 is initialized and the display of the operating unit (A) 58 is set to the clock mode, and a data is supplied to the display driver 57 through the line L2 so that the clock display displays "00:00".

A count of an internal timer of the microcomputer of the clock controller 56 is set in the RAM and the clock timer is started. When the internal timer is counted up, it interrupts the program of the microcomputer of the clock controller 56 to repetitively increment the data of the clock timer at every minute.

At this step, the power supply relay (K1) of the copying machine is not yet on and all of the displays of the operating unit (B) 67 remain off.

When the main switch 127 is manually turned on and off, the copying machine operates in the following manner.

(1) When the main switch 127 is manually turned on:

Following to the step 1, it is checked if the power-on time, power-off time and power-off reservation start time by the timer control have reached at steps 2, 4 and 7, respectively. In the present example, since the plug 51 has just been inserted, any mode is not set. Thus, the process proceeds to a step 9 where the status of the switches on the operating unit (A) 58 and the status of the ten-key 105 and the clear key 106 on the operating unit (B) 67 are supplied to the clock controller 56 through the line L4 and are written in the RAM. At a step 10, the status of the flag (main on) is checked. Since it is not set at this step, the process proceeds to a step 12. At the step 12, the key input data in the RAM is checked and if the status of the main switch 127 is "1" (on), the process goes to a step 13. Since the flag (main on) is not set at this step, the process goes to a step 17 and the power supply relay (K1) 61 is turned on and the on-time is stored in the RAM. The flag (main on) is set to store the turn-on of the main switch 127. The flag (on time) is reset. The flag (on time) will be explained in item (6) below. At a step 18, the key input data in the RAM is checked and if the status of the main switch 127 is not "0" (off), the process goes to a step 20 where the status of the flag (off time) is checked. Since it is not set at this step, the process goes to a step 25. At the step 25, the status of the switch 128 is checked and if it is the time set mode, the process goes to a step 26, and if it is the copy mode, the process returns to the step 2. The operation in the copy mode is first explained.

Since the decisions at the steps 2, 4 and 7 are still "NO", the status of the switches on the operating unit (A) 58 and the status of the ten-key 105 and the clear key 106 on the operating unit (B) 67 are again read in at the step 9 and the data are stored in the RAM. It is assumed that no switch has been depressed at this step. At the step 10, since the flag (main on) is set, it is determined that the power supply relay (K1) 61 of the copying machine is on and the process goes to the step 11 where data are exchanged with the device controller 65. The status of the ten-key 105 and the clear key 106 is sent from the clock controller 56 to the device controller 65, and the clock controller 56 receives the status data of the copying machine from the device controller 65. If the inhibition of the power-off is requested during the copy operation of the copying machine or within a predetermined time after the completion of the copying operation (for example, during auto-clear time), the flag (off inhibit) is set, and it is reset when the inhibition is released. The process again goes to the step 12. Since the status of the main switch 127 is not "1" (on) at this step, the process goes to the step 16 where the flag (on time) is checked. Since it is not yet set, the process goes to the step 18. Thereafter, the process goes to the steps 20 and 25 in the same manner as described above, and until the switch 128 selects the time mode, the status of the switches is read in at the step 9 under the timing controls at the steps 2, 4 and 7, and the clock controller 56 exchanges the data with the device controller at the step 11. In parallel with the proceedings of those steps, the internal timer of the microcomputer is counted up to count the time starting from the initial count set at the step 1 so that the clock display 139 is incremented at every minute.

(2) When the main switch 127 is manually turned off:

In the proceedings of the steps described in the item (1) above, the "0" (off) status of the main switch 127 is stored in the RAM at the step 9, the stored data is checked at the step 18, the power supply relay (K1) 61 is turned off, the flag (main on) is reset and the turn-off of the power supply of the copying machine is stored at the step 19, and the communication of the data with the device controller 65 is inhibited at the step 11.

The time set mode is now explained.

(3) When the time is set in the clock mode:

When the switch 128 is switched from the copy mode to the time set mode, the status is read and stored in the RAM at the step 9. When the process goes to the step 25, the mode is determined. Since it is the time set mode, the process goes to the step 26. If the switches on the operating unit (A) 58 and the ten-key 105 and the clear key 106 on the operating unit (B) 67 are off, the decisions at the steps 26, 28, 30, 32 and 33 are "NO" and the decision at the step 34 is "YES". Thus, the process goes to a step 39 where the flag (check) is checked. Since it is not yet set at this step, the process again goes back to the step 2 and repeats the steps from the start of the item (3) above. Let us assume that the operator inputs "12:30" by the ten-key 105 to set the time. When the "1" key is first depressed, it is read in at the step 9, and at the step 28, it is determined that the input data is the ten-key input data and the process goes to the step 29 where the display 139 displays "00:01". Similarly, "2", "3" and "0" are read in so that the display 139 sequentially displays "00:12", 37 01:23" and "12:30". When the operator depresses the start key 135, the data stored in the RAM at the step 9 is checked at a step 33, and the process goes to a step 43. Since it is the clock mode, the process goes to a step 44. Since the numerals displayed on the display 139, that is, the numerals set by the operator are already of four digits, the process goes to a step 45 where on time mode is checked. Since the decision is "NO", the process goes to a step 47. At the step 47, the off time mode is checked. Since the decision is "NO", the process goes to a step 49 where the four-digit numerals are stored at the address of the RAM specified by the display counter of the clock mode. The display counter will be explained in item (4). In the clock mode, since more than one time is not set, the display counter always remains "0" and the time data at the RAM address specified by the display counter 0 of the clock mode always represents the present time. This data is continuously incremented at every minute by the internal timer of the microcomputer. The process then goes to a step 50 where the numeric data on the temporary memory for the ten-key input is cleared and the time set in the display 139 is displayed and counted up. The flag (check) is then reset. In the clock mode, the flag (check) is not set. It is therefore explained in item (5) below. In the above description, the numeric data input is of four digits. If the start key 135 is depressed with only the three-digit input, the process goes to a step 51 because the numeric data is of three digits at a step 44, and then goes to the step 50 because the start key 135 is on. In this case, since the step 49 is skipped, the time data is not renewed at the step 50 and the old time that has been counted up is displayed on the display 139.

(4) When the power-on time or the power-off time is set in the on time mode or the off time mode:

The power-on time and the power-off time are set in the same manner. Therefore, only the power-on time is explained. When the operator depresses the on-time mode key 133, the status is read into the RAM at the step 9. The on time mode key is determined at the step 30 and the process goes to the step 31. At the step 31, the display 130 of the on time mode is lit to display the time on the display 139 so that the data in the temporary memory for the ten-key input in the course of setting of other time is cleared and the setting of the power-on time is enabled. Then, like in the item (3), the numeric data stored in the RAM at the step 9 is checked at the step 28 and the four-digit data is displayed on the clock display 139 at the step 29. Then, when the set key 138 is depressed, it is determined at the step 32 and the process goes to the steps 44 and 45. At the step 45, the on-time mode is checked. Since it is the on time mode, the process goes to the step 46 where a difference between the present power-off time and the newly registered power-on time is compared with $T_2$, and if it is longer than $T_2$, the process goes to the step 49 where the power-on time and the designated data in the temporary memory for the ten-key input are stored at the RAM address specified by the display counter of the on time mode. If there is no preset power-off time, the process unconditionally goes to the step 49. In the off time mode, the above decision is made at the steps 47 and 48 where the difference between the preset power-on time and the newly registered power-off time in the temporary memory for the ten-key input is compared with $T_2$. As a result, the time interval between the power-on time and the power-off time by the timer control does not become shorter than the predetermined time period $T_2$ so that the turn-off of the copying machine immediately after the turn-on by the missetting of the power-on time or the power-off time by the timer control is prevented. The predetermined time period $T_2$ may be set to a time period (one copy cycle) necessary to make a minimum size copy.

The display counter is now explained. When the power-on times and the power-off times are to be stored in the power-on time area and the power-off time area of the RAM in the sequence preset by the operator, the addresses thereof are allocated to the display counter. If three power-on times are set, "1", "2" and "3" are allocated to the display counter in the sequence of setting, and the power-on times are sequentially displayed on the display 139 in response to the input from the check key 136. Thus, when the fourth power-on time is set, it is stored at the RAM address specified by "4" of the display counter. The count of the display counter, that is, the number of the power-on times or the power-off times to be set may be determined in accordance with the capacity of the RAM.

Referring again to the flow chart, the process goes to the step 50 where the numeric data in the temporary memory for the ten-key input is cleared, the mode is changed to the clock mode, the display 130 is turned off and the display 129 is turned on. The present time is displayed on the clock display 139. In the above description, it is assumed that four-digit numeric data is inputted. If the set key is depressed when the three digits of numeric data is inputted, the input of the set key 138 is invalidated at the steps 44 and 51. However, the inputted three-digit numeric data is retained and fourth digit data can be inputted in sequence. If the inputted three-digit data is to be cleared, the clear key 106 is depressed and it is determined at the step 26. Then, at the step 27, the numeric data in the temporary memory for the ten-key input is cleared, the clock mode is selected, the display 130 is turned off and the display 129 is turned on.

If the difference between the power-on time and the power-off time is shorter than the predetermined time period $T_2$, the numeric data in the temporary memory for the ten-key input is not cleared and the clock mode is not selected. Thus, the display 130 remains lit.

Accordingly, when the operator sets the power-on time or power-off time, he or she can confirm if the correct time is set to the timer by watching the clock mode display 129 or the clock display.

(5) When the preset power-on time (or the power-off time) is to be confirmed or cancelled:

Since the operations of the on time mode and the off-time mode are same, only the on time mode is explained.

When the on time mode key 133 is depressed, the status is read into the RAM at the step 9 as is done in the item (4) above. The data is checked at the step 30 and the on time mode display 130 is turned on at the step 31 so that the time is displayed on the display 139. When the check key 136 is next depressed, the status is determined at the step 35 and the process goes to the step 36 where the flag (check) is set. Thereafter, the check in the on time mode is stored until the flag (check) is reset. The numeric data in the temporary memory for the ten-key input is cleared so that the numeric data in the course of time setting in the same mode (the on time mode) is cleared. The display counter is incremented. The display counter is at the reset state or "0" when the check key 136 is first depressed, and it is now incremented to "1". At the step 37, if the RAM address specified by "1" of the display counter contains the data, the process goes to the step 39 where the status of the flag (check) or the on time mode is checked. If the flag (check) is reset, that is, if it is not the on time mode, the process goes back to the step 2. In the present example, since the flag (check) is in the set status because the check key 136 has just been depressed, the process goes to the step 40 where the data at the RAM address specified by "1" of the display counter, that is, the preset power-on time is displayed on the clock display 139, and the process goes to the step 41. At the step 41, the status of the cancel key 137 is checked. Since it has not been depressed at this step, the process returns to the step 2 where the next check key input is read in. If there is no check key input by the operator, the decision at the step 35 is "NO" and the process goes to the steps 39 and 40 where the data at the RAM address specified by "1" of the display counter is continuously displayed on the clock diaplay 139. If the check key 136 is again depressed by the operator, the process goes to the steps 35 and 36 where the display counter is incremented to "2", and the data at the RAM address specified by "2" of the display counter is checked at the step 37, and if it is set, the process goes to the steps 39 and 40 where the data at the RAM address specified by "2" of the display counter, that is, the second preset power-on time is displayed on the display 139. The operator repeats the same operation N times. When the N-th preset power-on time is to be cancelled, the operator depresses the cancel key 137. Thus, at the step 41, the status of the cancel key 137 is checked and the process goes to the step 42 where the data at the RAM address specified by "N+1" of the display counter is shifted to the RAM address specified by "N" of the display counter and the data at "N+2" is shifted to the address "N+1". In this manner, the preset power-on time at the RAM address specified by "N" of the display counter is cancelled. The mode is changed to the clock mode, the display 130 is turned off and the display 139 is turned on to display the present time on the clock display 139. The display counter is reset and the flag (check) is reset, and the process returns to the step 2 where the next switch input is read in.

In the decision at the step 37, if the RAM address sepcified by "M" of the display counter does not contain data, the process goes to the step 38 where "1" is set in the display counter and the process goes to the step 39. Thus, each time when the operator depresses the check key 136, the operator can check the preset power-on time sequentially by the clock display 139. At the first run, that is, when the RAM address specified by "1" of the display counter does not contain the data, that is, when no power-on data has been set, the display displays blank.

By depressing the start key 135 during the process of either the item (4) or (5), the mode under execution determined at the step 33 or 51 is terminated and the mode is changed to the clock mode and the display 129 is turned on so that the present time is displayed on the clock display to prepare for the read-in of the next switch input. The operations of the respective modes are now explained.

(6) When the present time is the preset power-on time:

At the step 2, the present time is compared with the respective preset power-on times, and if it is equal to one of them, the process goes to the step 3 where the flag (on time) is set. At the step 16, the status of the flag (on time) is checked. Since it is in the set state, the process goes to the step 17 where the same operation as that for the manual turn-on of the main switch 127 described in the item (1) is carried out and the flag (on time) is reset.

(7) When the present time is the preset power-off time:

At the step 4, the present time is compared with the respective preset power-off times and if it is equal to one of them, the process goes to the step 5. At the step 5, the status of the flag (off alarm) is checked, and if it is in the set state, that is, if the turn-off of the power supply by the timer control is not inhibited by the operator by the operation of item (8) described below, the process goes to the step 6 where the flag (off time) is set. At the step 20, the status of the flag (off time) is checked. Since it is in the set state, the process goes to the step 21. At the step 21, the status of the flag (off inhibit) is checked, and if it is in the set state, the process returns to the step 2 from the step 25 to delay the turn-off of the power supply until the flag (off inhibit) is reset. Thus, in the data communication with the device controller 65 at the step 11 of the item (1), the turn-off of the power supply by the timer control is inhibited while the device controller 65 inhibits the turn-off of the power supply. When the inhibit request of the turn-off of the power supply by the device controller 65 is released, the process goes to the step 22. At the step 22, it is determined if the time period after the turn-on of the power supply is within a predetermined time period $T_1$, and if it is within $T_1$, the process goes to the step 24 where the flag (off time) is reset without turning off the power supply relay (K1) 61 to terminate the turn-off of the power supply by the timer control. This is carried out by comparing the present time with the turn-on time of the power supply stored in the RAM at the step 17. Thus, the turn-off of the power supply by the timer control before the operator starts the copying operation after he or she manually turned off the power supply of the copying machine and again turns it on is prevented. If the time period is not within the time $T_1$, the process goes to the step 23 where the power supply relay (K1) 61 is turned off in the same manner as the manual turn-off of the main switch 127 and the flag (main on) is reset, and at the step 24, the flag (off time) is reset to complete the operation.

(8) When the display of the closeness of the power-off time by the timer and the turn-off of the power supply by the timer are to be stopped:

At the step 7, the present time is checked to determine if it is $T_2$ time before any of the preset power-off times, and if it is, the process goes to the step 8 where the power off alarm display 140 is turned on and the flag (off alarm) is set. Thus, the operator is informed of the closeness of the power-off time by the timer control. If the operator wants to continue the copying operation, he or she manually depresses the main switch 127. Thus, the process goes to the steps 12 and 13, and at the step 14 the status of the flag (off alarm) is checked. Since the power off alarm is being displayed and the flag is in the set state, the process goes to the step 15. At the step 15, the flag (off alarm) is reset to skip the data of the power-off time next scheduled, and the power off alarm display 140 is turned off. Thus, the next preset power-off time coincides with the present time and even if the decision at the step 4 is "YES", the status of the flag (off alarm) is in the reset state at the step 5 and the process does not go to the step 6 and the flag (off time) is not set. Accordingly, when the power off alarm is being displayed, the power supply is not turned off by the timer if the main switch 127 is depressed.

In the present embodiment, the power off alarm display 140 may be a sound alarm.

In the item (4), the turn-on time period and the turn-off time period of the power supply are equal, although it is not essential. In the item (8), the time setting for the power off alarm display is $T_2$ like in the item (4), but the present invention is not limited thereto.

When the program is such that the power supply is turned on by the timer within a predetermined time period after the manual turn-off of the power supply, the turn-on of the power supply by the timer may be inhibited.

While the setting of the turn-on and turn-off periods and times has been described in the present embodiment, the present invention is also applicable to set the period or time required to auto-clear the copy count. The present invention is applicable to not only the copying machine but also other image forming apparatus such as facsimile, printer and video recorder.

As explained above, according to the present embodiment, the reservation control such as the turn-on and turn-off of the power supply can be readily achieved by the control panel of the copying machine. The power-on and power-off periods and times can be set by the copy count input means without requiring additional input means.

During the copying operation of the copying machine or within the predetermined time after the completion of the copying operation (for example, during the auto-clear operation), the power-off time by the timer control is delayed. Accordingly, the sudden turn-off of the power supply by the timer control during the copying operation is prevented. Accordingly, recopying operation by the operator is saved. Since the power supply is not turned off within the predetermined time period after the completion of the copying operation, there is a sufficient time for the operator to exchange an original to make another copy. Since the turn-off of the power supply by the timer within the predetermined time period after the manual turn-on of the power supply is inhibited, the turn-off of the power supply by the timer before the operator makes the copy by manually turning on the main switch is prevented.

Further, in accordance with the present embodiment, the closeness of the power-off time by the timer is informed to the operator, and if the operator wants to continue the copying operation, the turn-off of the power supply by the timer can be inhibited by turning on the main switch during the display of the power-off. Accordingly, the operator can continue the copying operation by the simple operation even if the power-off time is close.

In accordance with the present embodiment, if the turn-on or turn-off period of the power supply is shorter than the predetermined period, the setting of the turn-on or turn-off period of the power supply is inhibited. Accordingly, the turn-off of the power supply soon after the turn-on of the power supply by missetting of the period by the operator is prevented.

Further, in accordance with the present embodiment, a plurality of power-on and power-off periods by the timer can be set. Thus, the operation time of the copying machine can be set in accordance with a work schedule. The preset power-on and power-off periods can be sequentially checked by the simple operation. Therefore, the times preset by other operator can be readily checked. Since the power-on and power-off times can be displayed on the clock display, no additional space is required.

Accordingly, the operator can use the image forming apparatus without being troubled by the inconvenience (for example, the turn-off of the power supply during the copying operation) caused by the reservation of the turn-on and the turn-off of the power supply, and waste of time due to the miscopying and the additional setting of the reservation time is saved.

The present invention is not limited to the above embodiment but various modifications and changes may be made within the scope of the appended claims.

What is claimed is:

1. An image forming apparatus comprising:

image forming means for forming an image;

setting means for setting a turn-on or turn-off time of a power supply or the like of said image forming means; and control means for turning on or off said power supply or the like in accordance with the time set by said setting means;

said control means inhibiting the setting by said setting means when a turn-on or turn-off period of said power supply or the like is shorter than a predetermined time period.

2. An image forming apparatus according to claim 1 further comprising display means for displaying the time set by said setting means and displaying when the time, set by said setting means is inhibited.

3. An image forming apparatus according to claim 2 wherein said display means includes time display means for displaying present time.

4. An image forming apparatus according to claim 1 further comprising switching means for switching a mode of said setting means, wherein said setting means sets the number of times of image formation in accordance with the switching of said switching means.

5. An image forming apparatus according to claim 1 or 2 further comprising cancelling means for cancelling the time set by said setting means.

6. An image forming apparatus according to claim 1 further comprising display means for displaying the time set by said setting means and check means for checking the time set by said setting means.

7. An image forming apparatus according to claim 6 wherein said check means causes said display to sequentially display a plurality of the times set by said setting means.

8. An image forming apparatus comprising:
image forming means for forming an image;
setting means for setting a turn-on or turn-off time of a power supply or the like of said image forming means;
control means for turning on or off said power supply or the like in accordance with the time set by said setting means; and
informing means for coupled to said setting means for informing a user of the time set by said setting means.

9. An image forming apparatus according to claim 8 wherein said informing means preinforms when the present time is a predetermined time period before the set time.

10. An image forming apparatus according to claim 8 or 9 further comprising input means for inhibiting the turn-off of said power supply or the like by said setting means during the preinformation operation of said informing means.

11. An image forming apparatus according to claim 10 wherein said input means is a manually operated power-on switch.

12. An image forming apparatus according to claim 8 further comprising time display means for displaying the time set by said setting means and the present time.

13. An image forming apparatus according to claim 8 or 12 further comprising cancelling means for cancelling the time set by said setting means.

14. An image forming apparatus according to claim 8 or 12 further comprising checking means for checking the time set by said setting means.

15. An image recording apparatus comprising:
image recording means for recording an image;
setting means for setting a turn-on or turn-off time of a power supply or the like of said image recording means;
control means for controlling turn on or off of said power supply or the like in accordance with the time set by said setting means; and
inhibiting means for inhibiting the control by said control means in accordance with the time set by paid setting means under a predetermined condition.

16. An image recording apparatus according to claim 15 where said inhibiting means inhibits the control by said control means in accordance with the time set by said setting means during the operation of image recording by said image recording means or within a predetermined time period after the completion of the operation.

17. An image recording apparatus according to claim 15 or 16 further comprising time display means for displaying the time set by said setting means and the present time.

18. An image recording apparatus according to claim 15 or 16 further comprising cancelling means for cancelling the time set by said setting means.

19. An image recording apparatus according to claim 15 or 16 further comprising checking means for checking the time set by said setting means.

20. An image recording apparatus according to claim 16 wherein said inhibiting means determines if a predetermined time period has elapsed since the turn-on of said power supply or the like and inhibits the control by said control means to turn off said power supply or the like if said predetermined time period has not elapsed.

21. An image recording apparatus comprising:
image recording means for recording an image;
setting means for setting a turn-on or turn-off time of a power supply or the like of said image recording means;
control means for controlling turn on or off of said power supply or the like in accordance with the time set by said setting means; and
inhibiting means for inhibiting the control by said control means in accordance with the time set by said setting means when said power supply or the like is switched before the time set by said setting means.

22. An image recording apparatus according to claim 21 further comprising input means for manually turning on or off said power supply or the like, wherein said inhibiting means inhibits the control by said control means when the time set by said setting means is within a predetermined time period after the time of the manual switching of said power supply or the like.

23. An image recording apparatus according to claim 21 or 22 further comprising time display means for displaying the time set by said setting means and the present time.

24. An image recording apparatus according to claim 21 or 22 further comprising cancelling means for cancelling the time set by said setting means.

25. An image recording apparatus according to claim 21 or 22 further comprising checking means for checking the time set by said setting means.

26. An image forming apparatus according to claim 1 further comprising display means for sequentially displaying said plurality of turn-on or turn-off times set by said setting means.

27. An image forming apparatus according to claim 26 further comprising a check key for sequentially displaying the plurality of turn-on or turn-off times on said display means.

28. An image recording apparatus comprising:
image recording means for recording an image;
setting means for setting a turn-on or turn-off time of a power supply or the like of said image recording means;
control means for controlling turn on or off of said power supply or the like in accordance with the times set by said setting means; and
inhibiting means for inhibiting the control by said control means in accordance with the time set by said setting means when the time set by said setting means is within a predetermined time period after the time of the switching of said power supply or the like.

29. An image recording apparatus according to claim 28 further comprising input means for manually turning on or off said power supply or the like, wherein said inhibiting means inhibits the control by said control means to turn off said power supply or the like when the turn-off time set by said setting means is within said predetermined time period after the manual turn-on of said power supply or the like.

* * * * *